US012588719B2

(12) United States Patent
Person et al.

(10) Patent No.: US 12,588,719 B2
(45) **Date of Patent: *Mar. 31, 2026**

(54) CHEST PROTECTOR

(71) Applicant: Ampac Enterprises Inc., Shirley, MA (US)

(72) Inventors: Richard Person, Shirley, MA (US); Stan M. Jurga, Jr., Shirley, MA (US); Austin Rodrick, Shirley, MA (US); Ya Chi Chen, New Taipei City (TW)

(73) Assignee: Ampac Enterprises Inc., Shirley, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/808,242

(22) Filed: Aug. 19, 2024

(65) Prior Publication Data

US 2024/0407482 A1 Dec. 12, 2024

Related U.S. Application Data

(63) Continuation of application No. 17/864,478, filed on Jul. 14, 2022, now Pat. No. 12,063,989, which is a (Continued)

(51) Int. Cl.
*A41D 13/05* (2006.01)
*A41D 31/28* (2019.01)

(52) U.S. Cl.
CPC ..... *A41D 13/0518* (2013.01); *A41D 31/285* (2019.02); *A41D 2500/50* (2013.01)

(58) Field of Classification Search
CPC ..... A63B 71/08; A63B 2071/1208; A41D 13/0518
See application file for complete search history.

(56) References Cited

U.S. PATENT DOCUMENTS 3,607,601 A 9/1971 Milam, Jr. et al.
5,168,576 A 12/1992 Krent et al.
(Continued)

FOREIGN PATENT DOCUMENTS

JP 2002102021 4/2002
JP 2005264048 9/2005
(Continued)

OTHER PUBLICATIONS

Study Finds Unequal Technologies' Chest Protectors to Be First to Significantly Reduce Risk Cardiac Concussions for Youth Athletes. [Retrieved from the Internet: https://www.sporttechie.com/researchers-find-first-chest-protector-effective-commotio-cordis/]; Oct. 18, 2017.
(Continued)

*Primary Examiner* — Katherine M Moran
(74) *Attorney, Agent, or Firm* — Bradley Arant Boult Cummings LLP

(57) ABSTRACT

A chest pad that significantly reduces the occurrence of commotio cordis among athletes is disclosed. The chest pad may be utilized as a stand-alone chest protector intended to provide coverage primarily for the upper chest wall and the cardiac area. The chest pad may also be implanted into or utilized in traditional chest protectors that provide full coverage of the user's torso. The chest pad provides additional protection to the heart of the wearer such that impact in the heart area with a projectile is absorbed by the chest pad.

20 Claims, 8 Drawing Sheets

Related U.S. Application Data continuation of application No. 16/530,509, filed on Aug. 2, 2019, now Pat. No. 11,388,938.

(60) Provisional application No. 62/714,308, filed on Aug. 3, 2018.

(56) References Cited

U.S. PATENT DOCUMENTS

| | | | | |
|---|---|---|---|---|
| 6,021,528 | A | 2/2000 | Jurga et al. | |
| 6,282,724 | B1 | 9/2001 | Abraham et al. | |
| 6,775,851 | B1 | 8/2004 | Chen et al. | |
| 7,503,080 | B2 | 3/2009 | Link | |
| 7,900,283 | B1 | 3/2011 | Chen | |
| 7,993,277 | B1 | 8/2011 | Link | |
| 8,621,674 | B2 | 1/2014 | Perreault et al. | |
| 8,869,315 | B2 | 10/2014 | Contant et al. | |
| 10,414,921 | B1 | 9/2019 | Dehni | |
| 11,388,938 | B2 * | 7/2022 | Person | A41D 31/285 |
| 12,063,989 | B2 * | 8/2024 | Person | A63B 71/12 |
| 2006/0080762 | A1 | 4/2006 | Kobren et al. | |
| 2008/0113143 | A1 | 5/2008 | Taylor | |
| 2016/0377139 | A1 | 12/2016 | Vito | |
| 2017/0203190 | A1 | 7/2017 | Turner et al. | |
| 2019/0056203 | A1 | 2/2019 | Rodrigues | |
| 2019/0145740 | A1 | 5/2019 | Czerski et al. | |

FOREIGN PATENT DOCUMENTS

| | | |
|---|---|---|
| WO | 9205717 | 4/1992 |
| WO | 2018075108 | 4/2018 |

OTHER PUBLICATIONS

Weinstock, J., Failure of commercially available chest wall protectors to prevent sudden cardiac death induced by chest wall blows in an experimental model of commotio cordis, Pediatrics, Apr. 2006., 117(4): 656-62. Mar. 1, 2006.

Doerer, JJ, Evaluation of chest barriers for protection against sudden death due to commotio cordis, Am. J. Cardiol., Mar. 15, 2007, 2007; 99(6): 857-9, Jan. 26, 2007.

Ohanian, Paul, Could New Chest Protector Standard Reduce Cardiac Risk?, US Lacrosse Magazine, Jan. 23, 2017.

NOCSAE, Standard Test Method and Performance Specification Used in Evaluating the Performance Characteristics of Chest Protectors for Commotio Cordis, National Operating Committee on Standards for Athletic Equipment, Jun. 31, 2018.

Flexible Polyurethane Foam Having Closed Cells and Method for Producing the Same Global Dossier JP2005264048A_Translated_Jan. 26, 2021.pdf (Year: 2021).

A product with a cushioning material using the same Global Dossier Description (Translated) JP2002102021_A_TRANSLATED_Sep. 29, 2000_.pdf (Year: 2000).

Non-Final Office Action dated Jan. 5, 2024 of corresponding U.S. Appl. No. 17/864,478.

Advisory Action dated Feb. 18, 2022 of corresponding U.S. Appl. No. 16/530,509.

Final Office Action dated Nov. 4, 2021 of corresponding U.S. Appl. No. 16/530,509.

Non-Final Office Action dated May 4, 2021 of corresponding U.S. Appl. No. 16/530,509.

* cited by examiner

CHEST PROTECTOR

FIELD OF THE INVENTION

The present invention relates generally to protective chest wear. In particular, the present invention relates to chest pads and chest protectors for play involving various projectiles including baseball, lacrosse, and softball.

BACKGROUND OF THE INVENTION

Baseball and softball catchers are positioned behind home plate and perform many important functions during a game, from calling plays and protecting the plate to catching the ball thrown by the pitcher. Due to impacts from pitches, sometimes in excess of 90 mph, and home plate crashes with other players, the bodies of baseball players are regularly exposed to physical trauma. Similarly, lacrosse goalies are vulnerable to being struck with a high speed ball as the ball is shot into the goal. As a result, chest protectors and other protective equipment, such as shoulder pads, are primarily associated with baseball and softball catchers and lacrosse goalies. However, field players in baseball, softball, and lacrosse as well as batters and base runners are also at risk for getting injured from being struck with a projectile during play.

A particular concern in sports involving high speed projectiles is a phenomenon called commotio cordis. The phenomenon occurs when a blunt blow to the chest wall directly over the heart happens during a precise moment in the heart's cycle, disrupting its normal rhythm and causing cardiac arrest. The only effective response to commotio cordis is the immediate application of cardiopulmonary resuscitation (CPR) and deployment of a defibrillator (AED) to administer a controlled electric shock in order to allow restoration of the normal rhythm.

In addition to defibrillation and CPR, protective equipment may help to reduce the risk of commotio cordis. However, a 2006 study revealed that the seven baseball chest protectors and five lacrosse chest protectors tested on juvenile swines did not significantly decrease the occurrence of ventricular fibrillation (VF) when compared with controls and thus, these commercially available chest protectors were deemed ineffective in protecting against VF triggered by chest blows. More recently, with the exact cause of commotio cordis now known, testing on a mechanical surrogate has provided further guidance as to what thresholds must be met by protective equipment to prevent commotio cordis. In fact, the National Operating Committee on Standards for Athletic Equipment (NOCSAE) has arrived at a final standard test method and performance specification for use in evaluating the performance characteristics of chest protectors for commotio cordis (NOCSAE 200-17a m18). More recent research by Dr. Mark Link demonstrated that the majority of commercially available chest protectors, when tested on a mechanical surrogate, failed to decrease the incidence rate of commotio cordis. In other words, tests on the majority of commercially available chest guards found that there was not a significant difference in preventing commotio cordis between wearing the protection and not.

Accordingly, there remains a need in the art for improved protective equipment to reduce the occurrence of commotio cordis.

SUMMARY OF THE INVENTION

The present invention is directed to a chest pad that significantly reduces the occurrence of commotio cordis among athletes. The chest pad may be utilized as a standalone chest protector intended to provide coverage primarily for the upper chest wall and the cardiac area of the user. In another embodiment, the chest pad may be implanted and/or utilized in a larger chest protector that provides full coverage of the user's torso.

In one aspect, the present invention is directed to a chest protector including a base including ethylene vinyl acetate; a chest pad implanted into the chest protector or fastened to the front side of the base corresponding to the user's chest, wherein the chest pad includes a polymeric foam layer, a polymeric thermoplastic layer, and a memory foam layer; and a strapping system configured to removably and adjustably attach the chest protector.

The chest protector may further include a plurality of shoulder pads fastened to the front side of the base corresponding to the user's shoulders. The chest protector may also further include a plurality of abdomen pads including one or more upper abdomen pads corresponding to an upper portion of the user's abdomen, one or more lower abdomen pads corresponding to a lower portion of the user's abdomen, and one or more lateral abdomen pads corresponding to lateral sides of the user's abdomen.

According to one embodiment, the polymeric foam layer may include polyurethane foam having a density of about 13 $kg/m^3$ to about 33 $kg/m^3$ and a hardness of about 75 to 85. In another embodiment, the memory foam layer may have a density of about 47 $kg/m^3$ to about 70 $kg/m^3$ and a hardness of about 14 to 38. In still another embodiment, the polymeric thermoplastic layer may include polyethylene, high-density polyethylene (HDPE), polyethylene terephthalate (PET), or combinations thereof. The polymeric foam layer may be arranged directly adjacent to the base, the polymeric thermoplastic layer may be arranged directly adjacent to the polymeric foam layer, and the memory foam layer may be arranged directly adjacent to the polymeric thermoplastic layer such that the memory foam layer is the outermost layer.

In another aspect, the present invention is directed to a chest protector including a base including ethylene vinyl acetate; a plurality of shoulder pads fastened to a front side of the base corresponding to a user's shoulders; a chest pad implanted into the chest protector or fastened to the front side of the base corresponding to the user's chest, wherein the chest pad includes a polyurethane foam layer having a first density, a high-density polyethylene plate, and a memory foam layer having a second density, wherein the polyurethane foam layer is arranged directly adjacent to the base, the high-density polyethylene plate is arranged directly adjacent to the polyurethane foam layer, and the memory foam layer is arranged directly adjacent to the high-density polyethylene plate such that the polyurethane foam layer is the innermost layer; a plurality of upper and lower abdomen pads fastened to the front side of the base corresponding to the user's upper and lower abdomen respectively; a plurality of lateral abdomen pads fastened to the front side of the base corresponding to lateral sides of the user's abdomen; a plurality of lateral pads fastened to the front side of the base corresponding to lateral sides of the user's chest; and a strapping system configured to removably and adjustably attach the chest protector.

In one embodiment, the chest pad further includes a layer of ethylene vinyl acetate having a thickness of about 2.5 mm to about 10 mm. The layer of ethylene vinyl acetate may be disposed between the high-density polyethylene plate and the memory foam layer. In another embodiment, the second density is greater than the first density. For instance, the first density may be about 13 kg/m$^3$ to about 33 kg/m$^3$ and the second density may be about 47 kg/m$^3$ to about 70 kg/m$^3$. In still another embodiment, the polyurethane foam layer, the high-density polyethylene plate, and the memory foam layer are arranged in a vacuum-formed tray. In yet another embodiment, the polyurethane foam layer has a thickness of about 19 mm to about 30 mm, the high-density polyethylene plate has a thickness of about 3.98 mm to about 6 mm, and the memory foam layer has a thickness of about 12 mm to about 20 mm.

The present invention may further be directed to a chest protector including a base including ethylene vinyl acetate; a plurality of shoulder pads fastened to a front side of the base corresponding to a user's shoulders; a chest pad implanted into the chest protector or fastened to the front side of the base corresponding to the user's chest, wherein the chest pad includes a polyurethane foam layer having a first density of about 13 kg/m$^3$ to about 33 kg/m$^3$ and a first thickness of about 19 mm to about 30 mm, a high-density polyethylene plate having a second density of about 0.85 g/cm$^3$ to about 0.98 g/cm$^3$ and a second thickness of about 3.98 mm to about 6 mm, and a memory foam layer having a third density of about 47 kg/m$^3$ to about 70 kg/m$^3$ and a third thickness of about 12 mm to about 20 mm, wherein the polyurethane foam layer is arranged directly adjacent to the high-density polyethylene plate and the high-density polyethylene plate is arranged directly adjacent to the memory foam layer such that the polyurethane foam layer is the innermost layer; a plurality of abdomen pads fastened to the front side of the base corresponding to the user's abdomen; a plurality of lateral pads fastened to the front side of the base corresponding to lateral sides of the user's chest; and a strapping system configured to removably and adjustably attach the chest protector.

In this aspect, the first thickness is about 20 mm to about 25 mm, the second thickness is about 4 mm to about 5 mm, and the third thickness is about 14 mm to about 16 mm. In another embodiment, the polyurethane foam layer may have a hardness of about 75 to about 85. In still another embodiment, the memory foam layer may have a hardness of about 14 to about 38. In yet another embodiment, the chest pad further includes a layer of ethylene vinyl acetate having a thickness of about 3 mm to about 8 mm. In another embodiment, the first density is about 18 kg/m$^3$ to about 28 kg/m$^3$, the second density is about 0.88 g/cm$^3$ to about 0.96 g/cm$^3$, and the third density is about 50 kg/m$^3$ to about 65 kg/m$^3$.

BRIEF DESCRIPTION OF THE DRAWINGS

Further features and advantages of the invention can be ascertained from the following detailed description that is provided in connection with the drawings described below.

DETAILED DESCRIPTION OF THE INVENTION

The present invention is directed to a chest pad that provides enhanced protection for athletes and chest protectors including the chest pad. More particularly, the chest pad of the present invention provides coverage for the upper chest wall and cardiac area of the user and prevents high impact blows from disrupting the normal rhythm of the heart and causing cardiac arrest. The chest pads may also be implanted in or utilized in chest protectors that provide full coverage of the user's torso for a variety of players including, for example, field players in baseball, softball, and lacrosse, batters, base runners, catchers, and goalies. Through the use of the chest pad of the present invention, the chest protectors of the present invention provide additional protection for the area around the heart while also providing maximum freedom of movement for the user.

Figure 1:
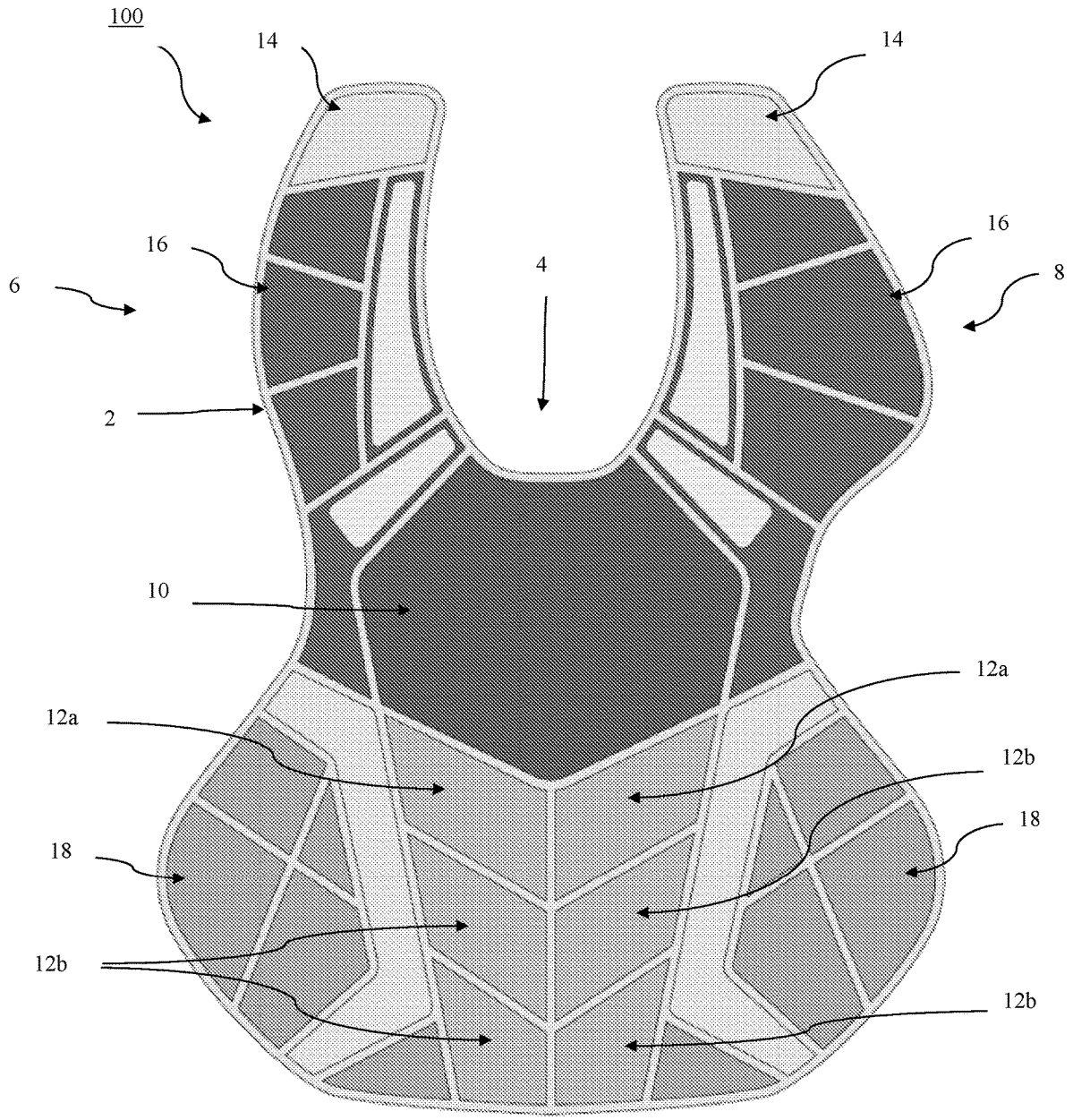
FIG. 1 shows a schematic front view of a chest protector according to one embodiment of the present invention.

Referring to FIG. 1, a chest protector in accordance with one embodiment of the present invention is shown. The chest protector of the present invention is suitable for both adults and youths. As will be apparent to one of ordinary skill in the art, the design and dimensions of a youth version of the chest protector according to the present invention is proportional to an adult version of the chest protector according to the present invention.

The chest protector 100 includes a base 2 having a central panel 4 and side panels 6, 8 along each side of the central panel 4. The base 2 is generally shaped to protect the front side of the user's torso including the shoulders, neck, chest, and abdomen. In another embodiment, the base 2 may be shaped to protect only the upper portion of the user's torso, for example, the chest and cardiac area. The base may be made of any material having a suitable thickness that provides adequate shock absorbing properties and protection from high impact blows, for example, from speeding balls. In one embodiment, the base 2 is made of ethylene vinyl acetate foam. The base 2 may also be coated with a microorganism-resisting and mildew-retarding treatment agent. In another embodiment, the base 2 may include a plurality of air vents.

As shown in FIG. 1, the front side of the base 2 includes a central panel 4 and side panels 6, 8. Each of the central panel 4 and side panels 6, 8 are composed of a plurality of pads. In one embodiment, the central panel 4 includes a chest pad 10 and a plurality of abdomen pads 12. The central panel 4 may also optionally include a neck pad (not pictured) fastened to the top side of the base 2 corresponding to the user's neck.

In another embodiment, the central panel 4 may include only the chest pad 10. That is, the chest pad 10 may be adapted to a stand-alone chest protector that provides coverage primarily for the upper chest wall and cardiac area of the user. This allows for greater freedom of movement for users such as field players, batters, and baserunners that desire enhanced protection for the cardiac area, but do not necessarily require the protection of a full torso chest protector.

The chest pad 10 is designed to provide enhanced protection for the area around the heart of the user from the force of impacts, such as high impact blows, during sporting activities. In one embodiment, as shown in FIG. 1, the chest pad 10 is positioned in the upper portion of the central panel 4. For example, the chest pad 10 should be centrally positioned over the chest of the user so as to protect the sternum as well as the adjoining ribs of the user from the force of impacts.

The shape and dimensions of the chest pad 10 may vary so long as the chest pad 10 provides adequate protection of the user's chest including the sternum, adjoining ribs, and area around the heart. In one embodiment, the chest pad 10 may be a single, unitary pad (as shown in FIG. 1). In this aspect, the chest pad 10 may be polygonal in shape, for example, pentagonal, hexagonal, heptagonal, octagonal, nonagonal, or decagonal. In one embodiment, as shown in FIG. 1, the chest pad 10 is a single, unitary pad having a heptagonal shape.

Figure 2:
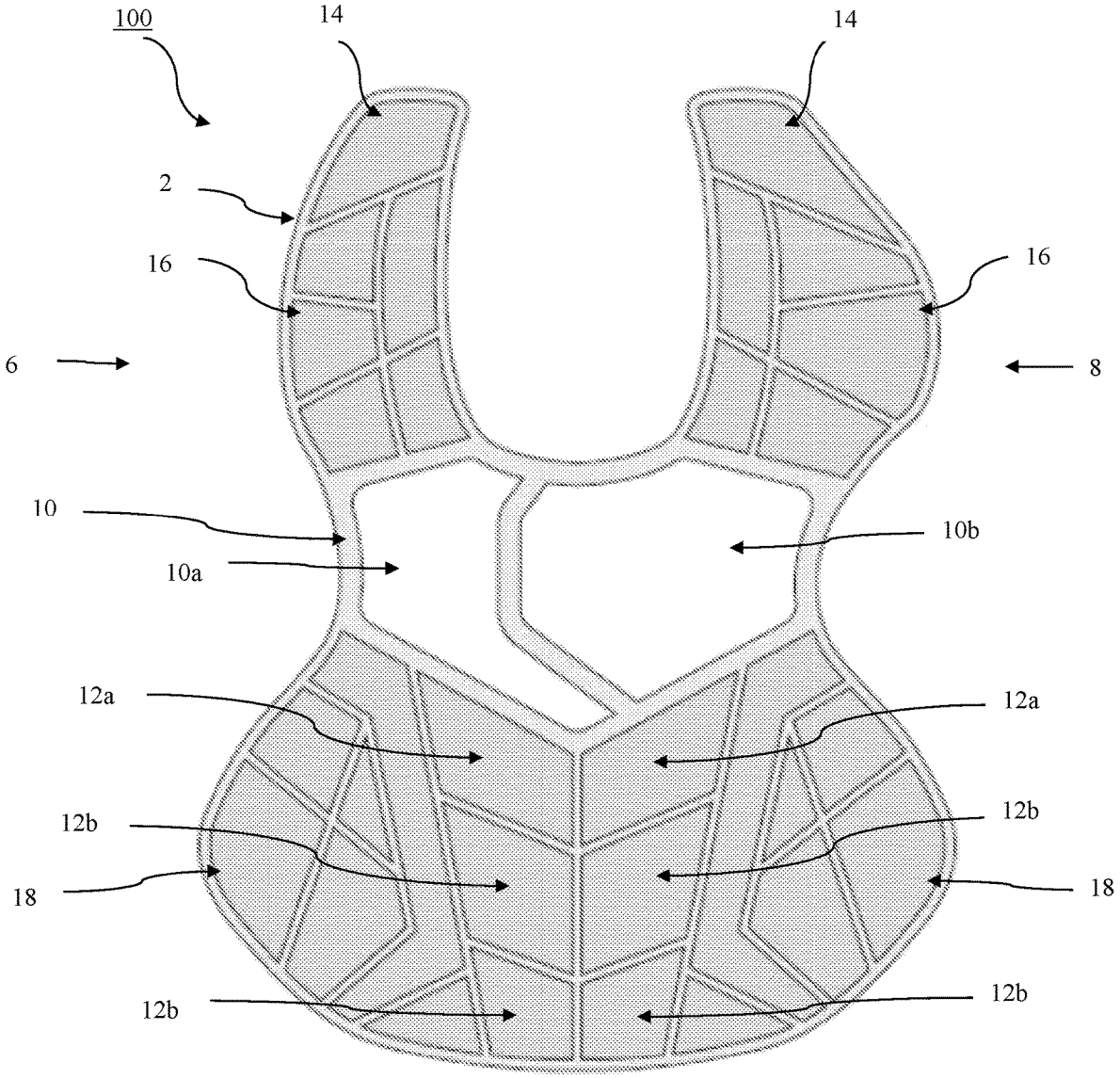
FIG. 2 shows a schematic front view of a chest protector according to another embodiment of the present invention.

In another embodiment, the chest pad 10 may be composed of more than one pad. For instance, the chest pad 10 may include two or more pads. In still another embodiment, the chest pad 10 may include three or more pads. Regardless of the number of pads, each pad should have a shape that interlocks with the other(s) to form the chest pad 10. The shape of each pad may vary so long as each pad cohesively interlocks with the other(s) to provide continuous protection across the user's chest. FIG. 2 shows a chest protector 100 having two pads 10*a*, 10*b* that interlock to form a chest pad 10. Pads 10*a*, 10*b* are generally polygonal in shape; however, the shape of pad 10*a* is designed to join with the shape of pad 10*b* to form chest pad 10 that extends across the user's chest.

The chest pad 10 generally conforms in size to cover the chest area of the user. In one embodiment, the chest pad 10 has a length of about 7.25 inches to about 8.75 inches. In another embodiment, the chest pad 10 has a length of about 7.5 inches to about 8.5 inches. In still another embodiment, the chest pad 10 has a length of about 7.75 inches to about 8.25 inches. The chest pad 10 may have a height of about 6 inches to about 8 inches. In one embodiment, the chest pad 10 has a height of about 6.25 inches to about 7.5 inches. In another embodiment, the chest pad 10 has a height of about 6.25 inches to about 7 inches.

The chest pad 10 is composed of a plurality of impact-resistant materials. The combination of impact-resistant materials disclosed herein may significantly reduce the risk of occurrence of commotio cordis to a user participating in an athletic activity. Indeed, the disclosed combination of impact-resistant materials are able to absorb an impact in the heart area from a projectile. In one embodiment, the chest pad 10 includes at least a polymeric foam layer and a polymeric thermoplastic layer. In another embodiment, the chest pad 10 includes at least the polymeric foam layer, the polymeric thermoplastic layer, and a memory foam layer. In still another embodiment, the chest pad 10 includes at least the polymeric foam layer, the polymeric thermoplastic layer, the memory foam layer, and a layer of ethylene-vinyl acetate. The chest pad 10 may also include additional layers of impact-resistant materials known to those of ordinary skill in the art, for example, additional elastomer or polymeric layers.

In another embodiment, the chest pad 10 may further include a fabric material surrounding the layers of impact-resistant materials. The fabric material may collectively surround the polymeric foam layer, the polymeric thermoplastic layer, the memory foam layer, and the layer of ethylene-vinyl acetate (if used). The fabric material may be provided to increase comfort and/or the aesthetic appearance of the chest pad 10. In one embodiment, the chest pad 10 may be built into the chest protector 100 such that the fabric material covers the chest pad 10 as well as the other padding fastened to base 2.

The layers of impact-resistant materials are arranged in a particular order to dissipate the force of impacts to the chest pad 10. For example, to provide enhanced protection for the user, the polymeric foam layer may be the innermost layer of the chest pad 10 while the polymeric thermoplastic layer or memory foam layer may be the outermost layer of the chest pad 10.

Figure 3:
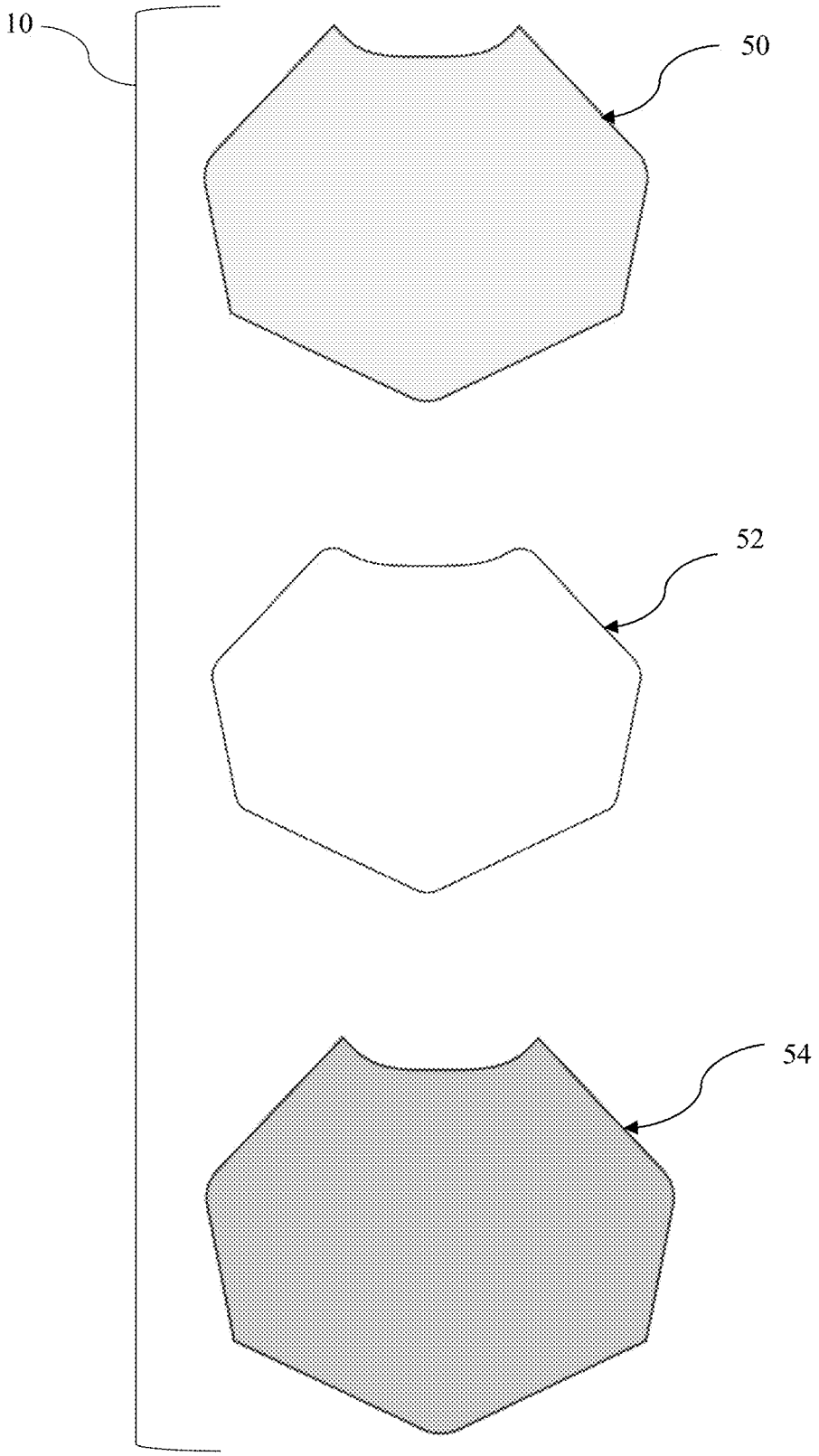
FIG. 3 shows a schematic front view of the components of a chest pad according to one embodiment of the present invention.

FIG. 3 shows an arrangement of layers of impact-resistant materials that may be utilized in the chest pad 10. In this embodiment, the polymeric foam layer 50 may be arranged directly adjacent to the polymeric thermoplastic layer 52 and the polymeric thermoplastic layer 52 may be arranged directly adjacent to the memory foam layer 54. In this aspect, the polymeric foam layer 50 is the innermost layer of the chest pad 10 such that the polymeric foam layer 50 is arranged on top of the base 2 (e.g., on top of ethylene vinyl acetate foam) and the memory foam layer 54 is the outermost layer of the chest pad 10. This arrangement is also demonstrated in the cross-section views of chest pad 10 in FIGS. 5 and 6, which are discussed in more detail below.

Figure 4:
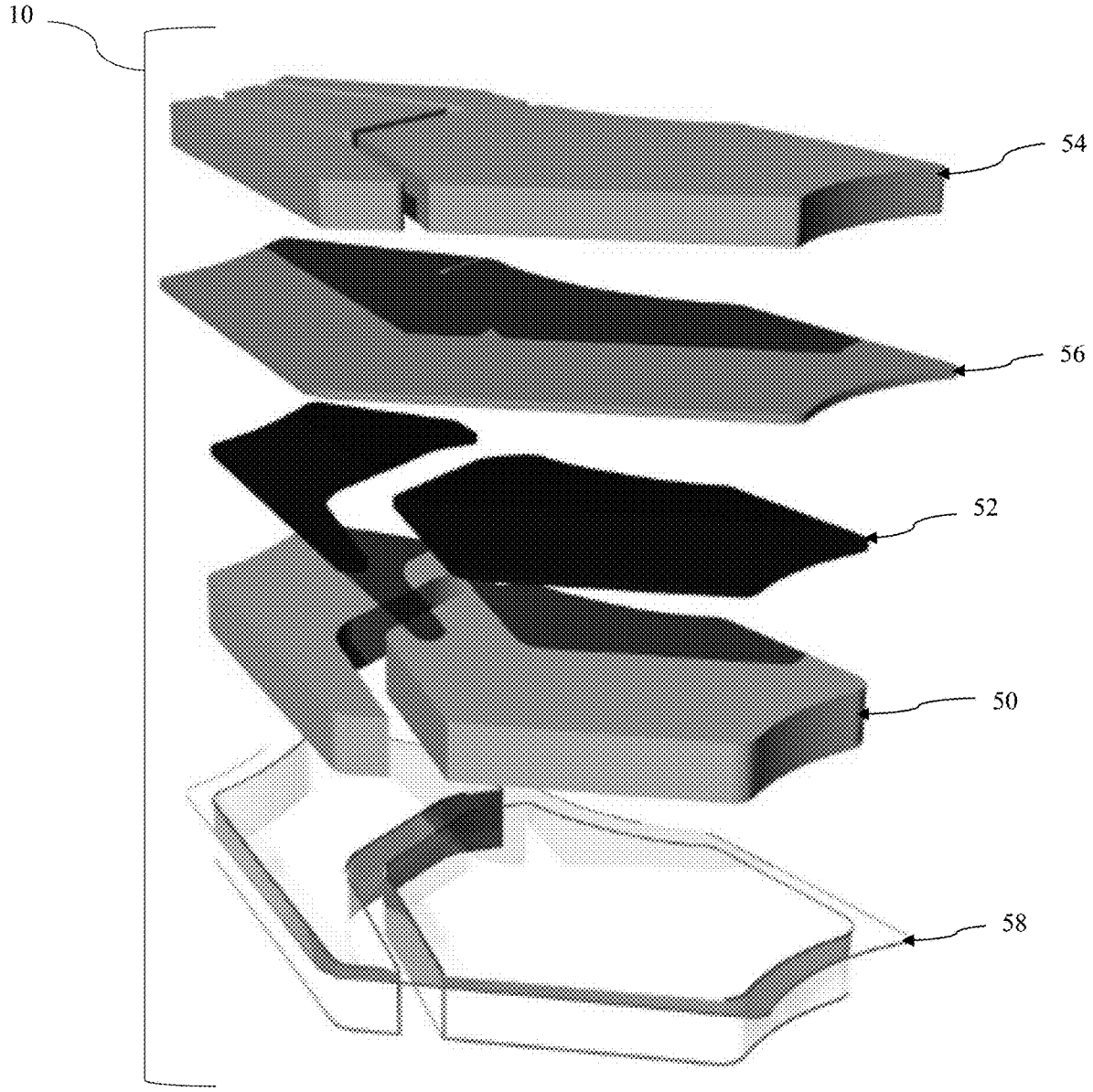
FIG. 4 shows a lateral view of the components of a chest pad according to an another embodiment of the present invention.

FIG. 4 shows another arrangement of layers of impact-resistant materials that may be utilized in the chest pad 10. In this aspect, the polymeric foam layer 50 may be arranged directly adjacent to the polymeric thermoplastic layer 52, the polymeric thermoplastic layer 52 may be arranged directly adjacent to the layer of ethylene-vinyl acetate 56, and the layer of ethylene-vinyl acetate 56 may be arranged directly adjacent to the memory foam layer 54. In this aspect, the polymeric foam layer 50 is the innermost layer of the chest pad 10 such that the polymeric foam layer is arranged on top of the base 2 (e.g., on top of ethylene vinyl acetate foam) and the memory foam layer 54 is the outermost layer of the chest pad 10.

In this aspect, the layers of impact-resistant materials discussed above may be arranged in a tray to provide additional support and protection. In one embodiment, the impact-resistant materials may be arranged in a vacuum formed tray. As shown in FIG. 4, the polymeric foam layer 50, the polymeric thermoplastic layer 52, the layer of ethylene-vinyl acetate 56, and the memory foam layer 54 may be arranged in the tray 58. Tray 58 not only holds the layers in place, but also provides an additional layer of protection in the chest pad 10.

In one embodiment, the polymeric foam layer 50 has a density of about 13 $kg/m^3$ to about 33 $kg/m^3$. In another embodiment, the polymeric foam layer 50 may have a density of about 18 $kg/m^3$ to about 28 $kg/m^3$. In yet another embodiment, the polymeric foam layer 50 may have a density of about 20 $kg/m^3$ to about 25 $kg/m^3$. In still another embodiment, the polymeric foam layer 50 may have a density of about 23 $kg/m^3$ to about 25 $kg/m^3$. Additionally, the polymeric foam layer 50 should have a hardness of about 75 to 85. Unless otherwise specified, all hardness values disclosed herein refer to hardness measured using an Asker Type F durometer. In another embodiment, the polymeric foam layer 50 may have a hardness of about 78 to about 83. In still another embodiment, the polymeric foam layer 50 may have a hardness of about 80 to about 82. Suitable materials for forming the polymeric foam layer 50 include, but are not limited to, various types of polyurethane foam. In one embodiment, the polymeric foam layer 50 is formed of polyurethane foam. For instance, the polymeric foam layer 50 may be formed from a polyurethane foam having a density of about 13 kg/m$^3$ to about 33 kg/m$^3$ and a hardness of about 75 to 85.

The polymeric thermoplastic layer 52 may have a density of about 0.85 g/cm$^3$ to about 0.98 g/cm$^3$. In another embodiment, the polymeric thermoplastic layer 52 may have a density of about 0.88 g/cm$^3$ to about 0.96 g/cm$^3$. In still another embodiment, the polymeric thermoplastic layer 52 may have a density of about 0.92 g/cm$^3$ to about 0.95 g/cm$^3$. In addition, the polymeric thermoplastic layer 52 may have a hardness of about 55 to 70 Shore D. The Shore D hardness values were measured according to ASTM D2240. In another embodiment, the polymeric thermoplastic layer 52 may have a hardness of about 60 to 68 Shore D. In still another embodiment, the polymeric thermoplastic layer 52 may have a hardness of about 62 to 67 Shore D. In yet another embodiment, the polymeric thermoplastic layer 52 may have a hardness of about 64 to 66 Shore D.

The polymeric thermoplastic layer 52 may be formed from materials including, but not limited to, polyethylene, high-density polyethylene (HDPE), polyethylene terephthalate (PET), and combinations thereof. For example, in one embodiment, the polymeric thermoplastic layer 52 is formed of HDPE.

The memory foam layer 54 should have a density greater than the density of the polymeric foam layer 50. In this aspect, the density of the memory foam layer 54 is at least about 10 kg/m$^3$ greater than the density of the polymeric foam layer 50. In another embodiment, the density of the memory foam layer 54 is at least about 15 kg/m$^3$ greater than the density of the polymeric foam layer 50. In still another embodiment, the density of the memory foam layer 54 is at least about 20 kg/m$^3$ greater than the density of the polymeric foam layer 50. In yet another embodiment, the density of the memory foam layer 54 is at least about 25 kg/m$^3$ greater than the density of the polymeric foam layer 50. In still another embodiment, the density of the memory foam layer 54 is at least about 30 kg/m$^3$ greater than the density of the polymeric foam layer 50.

In one embodiment, the memory foam layer 54 has a density of about 47 kg/m$^3$ to about 70 kg/m$^3$. In another embodiment, the memory foam layer 54 has a density of about 50 kg/m$^3$ to about 65 kg/m$^3$. In yet another embodiment, the memory foam layer 54 has a density of the about 52 kg/m$^3$ to about 62 kg/m$^3$. In still another embodiment, the memory foam layer 54 has a density of the about 55 kg/m$^3$ to about 60 kg/m$^3$. In this aspect, the memory foam layer 54 should have a hardness less than the hardness of the polymeric foam layer 50. In one embodiment, the memory foam layer 54 has a hardness of about 14 to 38. In another embodiment, the memory foam layer 54 may have a hardness of about 18 to 35. In still another embodiment, the memory foam layer 54 may have a hardness of about 20 to about 32. In yet another embodiment, the memory foam layer 54 may have a hardness of about 22 to about 28.

The memory foam layer 54 may be formed of low-resilience polyurethane foam (LRPu). For instance, in one embodiment, the memory foam layer 54 may be formed of LRPu having a density of about 47 kg/m$^3$ to about 70 kg/m$^3$ and a hardness of about 14 to 38.

The use of the disclosed impact-resistant materials in chest pad 10 helps to adequately protect the user's chest from high impact forces. However, the thickness of chest pad 10 should also enable comfort, flexibility, and case of movement during sporting activities. As such, the layers of impact-resistant materials in chest pad 10 should be sufficiently thin enough not to hinder the user's movement, but also protect the user from high impact blows, which may disrupt the normal rhythm of the heart and cause cardiac arrest.

In one embodiment, the polymeric foam layer 50 may have a thickness of about 19 mm to about 30 mm. In another embodiment, the polymeric foam layer 50 may have a thickness of about 20 mm to about 27 mm. In still another embodiment, the polymeric foam layer 50 may have a thickness of about 20 mm to about 25 mm. In yet another embodiment, the polymeric foam layer 50 has a thickness of about 20 mm to about 22 mm. For instance, the polymeric foam layer 50 may have a thickness of about 20 mm.

The polymeric thermoplastic layer 52 may have a thickness of about 3.98 mm to about 6 mm. In another embodiment, the polymeric thermoplastic layer 52 may have a thickness of about 4 mm to about 5.5 mm. In still another embodiment, the polymeric thermoplastic layer 52 may have a thickness of about 4 mm to about 5 mm. In yet another embodiment, the polymeric thermoplastic layer 52 may have a thickness of about 4 mm to about 4.02 mm. For example, the polymeric thermoplastic layer 52 may have a thickness of about 4 mm.

When the layer of ethylene-vinyl acetate 56 is used in the chest pad 10, the layer of ethylene-vinyl acetate 56 may have a thickness of about 2.5 mm to about 10 mm. In another embodiment, the layer of ethylene-vinyl acetate 56 may have a thickness of about 3 mm to about 8 mm. In yet another embodiment, the layer of ethylene-vinyl acetate 56 may have a thickness of about 3 mm to about 6 mm. In still another embodiment, the layer of ethylene-vinyl acetate 56 may have a thickness of about 3 mm to about 4 mm.

The memory foam layer 54 may have a thickness of about 12 mm to about 20 mm. In another embodiment, the memory foam layer 54 may have a thickness of about 13 mm to about 18 mm. In still another embodiment, the memory foam layer 54 may have a thickness of about 14 mm to about 16 mm. In yet another embodiment, the memory foam layer 54 may have a thickness of about 14 mm to about 15 mm. For instance, the memory foam layer 54 may have a thickness of about 14 mm.

In this aspect, the chest pad 10 may have a total thickness of about 34 mm to about 67 mm. In another embodiment, the chest pad 10 may have a total thickness of about 38 mm to about 60 mm. In still another embodiment, the chest pad 10 may have a total thickness of about 40 mm to about 56 mm. In yet another embodiment, the chest pad 10 may have a total thickness of about 44 mm to about 50 mm.

Figure 5:
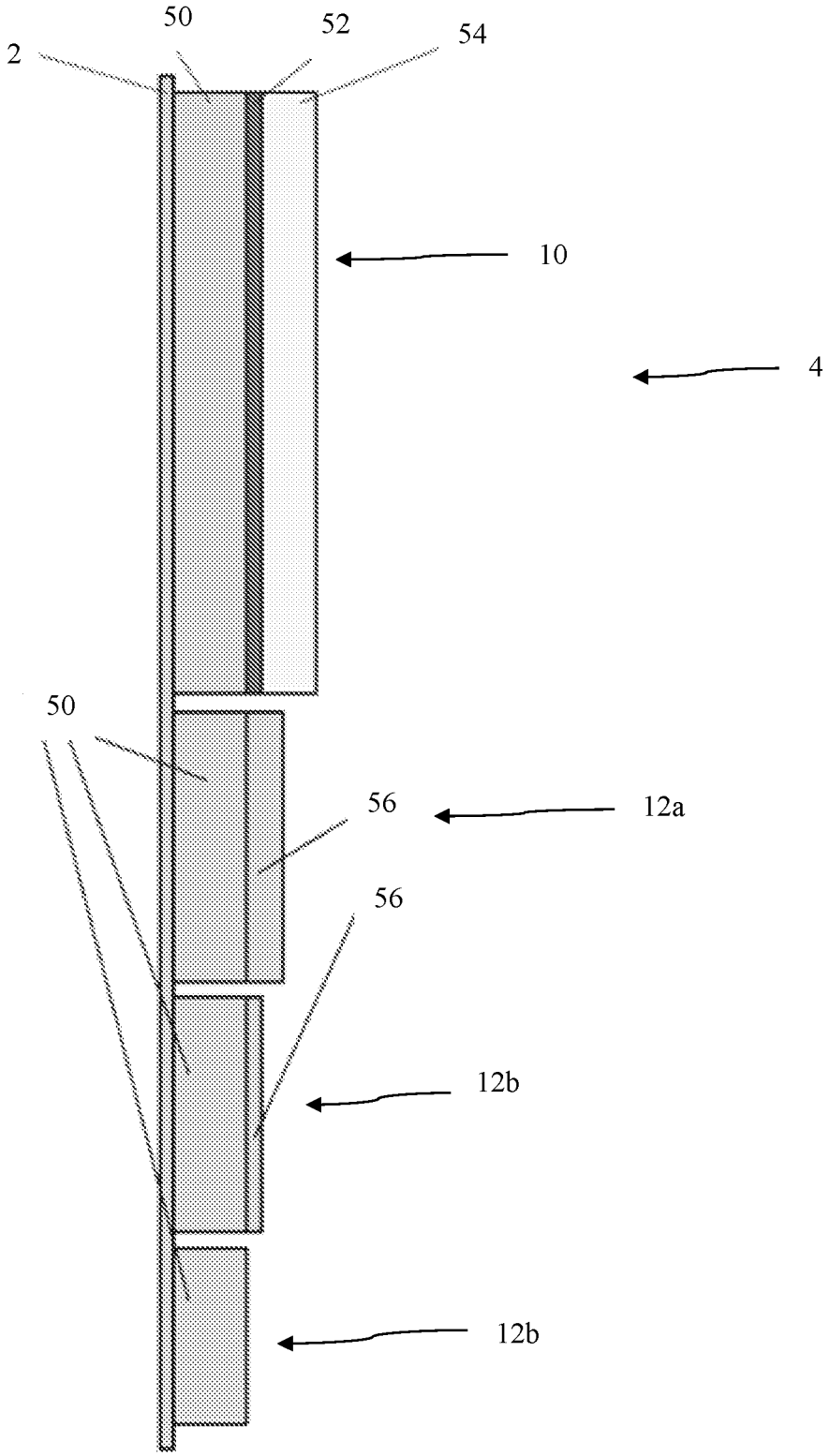
FIG. 5 shows a cross-sectional view of a chest protector according to one embodiment of the present invention.
Figure 6:
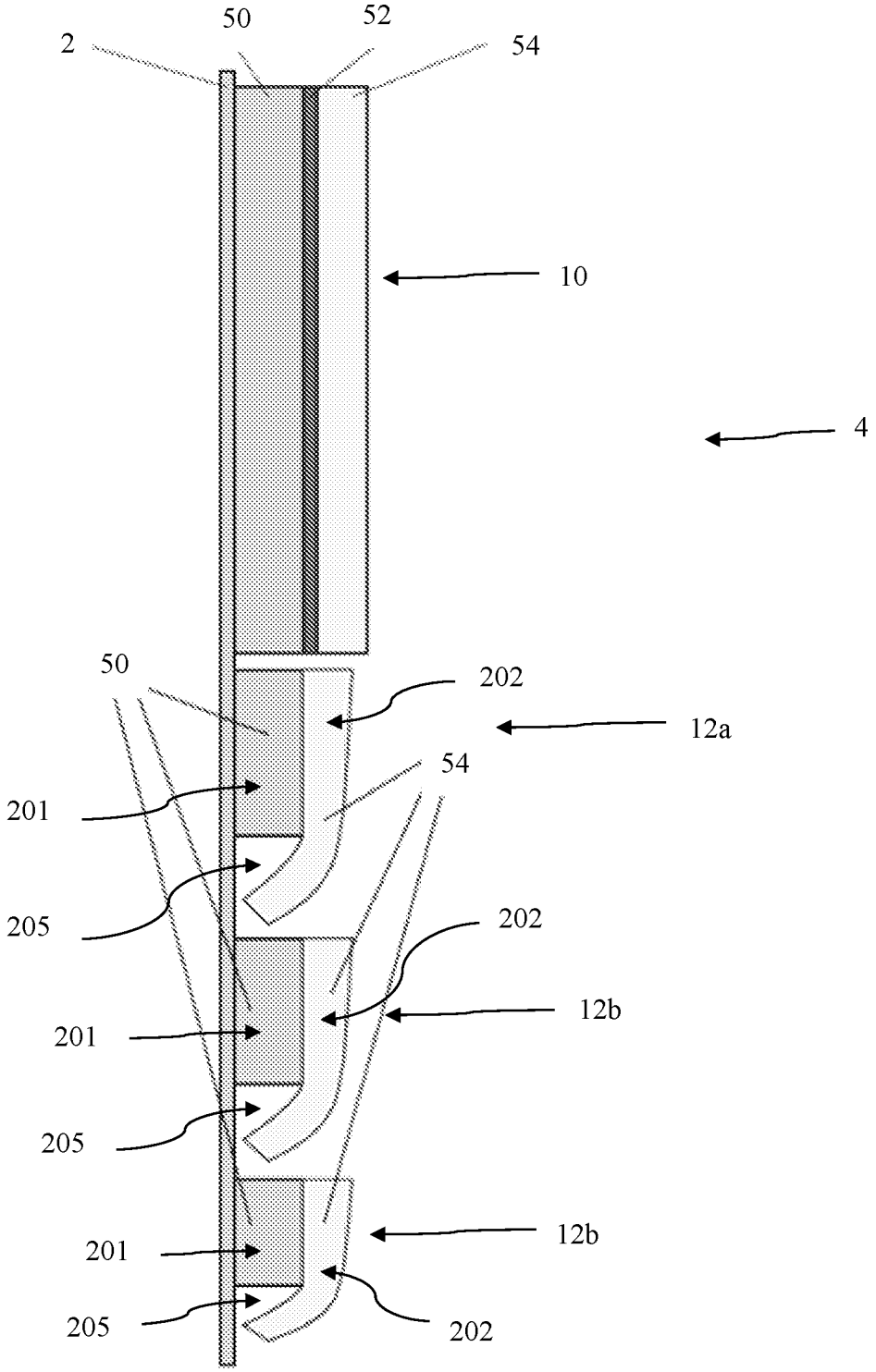
FIG. 6 shows a cross-sectional view of a chest protector according to another embodiment of the present invention.

The central panel 4 may or may not include a plurality of abdomen pads. As discussed above, the central panel 4 may include only the chest pad 10 to provide greater freedom of movement for users that do not require the protection provided by a full chest protector. In another embodiment, the central panel 4 may include a plurality of abdomen pads 12 that are respectively fastened to the front side of the base 2 corresponding to the front portion of the user's abdomen. The number and arrangement of abdomen pads on the chest protector 100 may vary so long as the abdomen pads provide sufficient protection and shock absorbing properties for the abdomen of the user. In one embodiment, as shown in FIG. 1, the central panel 4 includes at least two upper abdomen pads 12*a* and at least four lower abdomen pads 12*b*. The upper abdomen pads 12*a* and the lower abdomen pads 12*b* may be made of any material that allows for support and protection of the user's abdomen. In one embodiment, the upper and lower abdomen pads 12*a*, 12*b* are formed of expanded polyurethane (e.g., polyurethane foam), cross-linked polyethylene, soft rubber foam, memory foam, gel padding, or compression molded foams such as ethyl vinyl acetate (EVA). In another embodiment, the upper and lower abdomen pads 12*a*, 12*b* may be formed of multiple layers of any of the above-mentioned materials. For instance, as shown in FIG. 5, the upper and lower abdomen pads 12*a*, 12*b* may each include an inner polymeric foam layer 50 and an outer layer of EVA 56. In another embodiment, as shown in FIG. 6, the upper and lower abdomen pads 12*a*, 12*b* may each include an inner polymeric foam layer 50 and an outer memory foam layer 54. The upper and lower abdomen pads 12*a*, 12*b* may be also be encased in a thin, resilient covering of plastic material.

In one embodiment, the upper and lower abdomen pads 12*a*, 12*b* may be designed such that the pads decrease in thickness from the upper abdomen pads 12*a* to the lower abdomen pads 12*b*. FIG. 5 provides a cross-section view of central panel 4 including chest pad 10 and upper and lower abdomen pads 12*a*, 12*b*. In FIG. 5, each abdomen pad decreases in thickness from the upper most abdomen pad 12*a* to the lowest abdomen pad 12*b*. As can be seen, the upper abdomen pad 12*a* has a greater total thickness than the lower abdomen pads 12*b*. In this aspect, the total thickness of the upper abdomen pads 12*a* may range from about 25 mm to about 40 mm. In another embodiment, the total thickness of the upper abdomen pads 12*a* may range from about 28 mm to about 35 mm. In still another embodiment, the total thickness of the upper abdomen pads 12*a* may range from about 30 mm to about 32 mm. The total thickness of each of the lower abdomen pads 12*b* may range from about 15 mm to about 35 mm. In another embodiment, the total thickness of each of the lower abdomen pads 12*b* may range from about 20 mm to about 30 mm. In still another embodiment, the total thickness of each of the lower abdomen pads 12*b* may range from about 20 mm to about 24 mm.

In another embodiment, the upper and lower abdomen pads 12*a*, 12*b* may be designed such as those featured in U.S. Pat. No. 7,900,283, which is herein incorporated by reference in its entirety. In this aspect, the upper and lower abdomen pads 12*a*, 12*b* may each include an inner low bounce foam, for example, a polyurethane foam, and an outer low bounce foam, for example, memory foam, that enhance the shock-absorbing and buffering effects of the chest protector. FIG. 6 provides a cross-section view of central panel 4 including chest pad 10 and upper and lower abdomen pads 12*a*, 12*b*. As shown in FIG. 6, the upper abdomen pad 12*a* and the lower abdomen pads 12*b* each include an inner low bounce foam 201 (e.g., a polymeric foam layer 50) and an outer low bounce foam 202 (e.g., a memory foam layer 54). In one embodiment, the inner low bounce foams 201 are shorter than the outer low bounce foams 202 so that buffer spaces 205 are provided between the respective outer low bounce foams 202 and the base 2. In this aspect, the inner low bounce foams 201 are softer than the respective outer low bounce foams 202 so that the outer low bounce foams 202 are held in a sloping position with a buffer space 205. In one embodiment, the buffer spaces 205 enhance the shock-absorbing properties and buffering effects of the chest protector, while the sloping angle of the outer low bounce foams 202 help guide a ball to land in front of the user.

The chest protector 100 may or may not include side panels 6, 8. When the left and right side panels 6, 8 are included on the chest protector 100, the left and right side panels 6, 8 may be composed of a plurality of pads. Each of the side panels 6, 8 may include shoulder pads 14 corresponding to the user's shoulders. In another embodiment, each of the side panels 6, 8 may include one or more shoulder covers (not pictured). The shoulder cover may be integrally formed with or detachably secured to base 2. In one embodiment, the shoulder cover is detachably secured to base 2 so that it can be secured at different positions along the shoulder area of the user. For instance, the shoulder cover may be removably attached to base 2 with hook-and-loop closures, such as Velcro®, snaps, clips, or the like.

Side panels 6, 8 may also include a plurality of lateral pads that extend from the user's shoulders downward to the lateral and bottom portion of the user's abdomen. The shape, number, and arrangement of the lateral pads may vary. In one embodiment, side panels 6, 8 may each include one or more lateral pads 16 that extend from the shoulder pads 14 to the upper abdomen pads 12*a*. The lateral pads 16 are fastened to the front side of base 2 and surround chest pad 10 to provide additional protection to the user's chest area. In another embodiment, side panels 6, 8 may also each include one or more lateral abdomen pads 18. Lateral abdomen pads 18 are fastened to the front side of base 2 and correspond to the two opposite lateral sides of the user's abdomen. Lateral abdomen pads 18 are intended to protect the portions of the user's abdomen that are not covered by the upper and lower abdomen pads 12*a*, 12*b*.

Shoulder pads 14, lateral pads 16, and lateral abdomen pads 18, may be made of any material that allows for support and protection of the user's torso. In one embodiment, the pads are formed of expanded polyurethane (e.g., polyurethane foam), cross-linked polyethylene, soft rubber foam, memory foam, gel padding, or compression molded foams such as EVA. In another embodiment, the pads may be formed of multiple layers of any of the above-mentioned materials. The pads may also be encased in a thin, resilient covering of plastic material and the peripheral edges are covered by a plastic sewn-in-place binding. In another embodiment, the pads may be coated with a microorganism-resisting and mildew-retarding treatment agent.

The chest protector 100 is removably and adjustably attachable to the torso of a user. In one embodiment, the chest protector 100 includes a strapping system that is provided to secure the chest protector 100 in position. The strapping system of the present invention may include a back harness such as the harness described in U.S. Pat. No. 6,021,528, which is herein incorporated by reference in its entirety. In this aspect, the back harness may include a center harness material that is designed to cushion the back of the user and one or more straps attached to the center harness material. The one or more straps may include at least a pair of upper shoulder straps and a pair of lower shoulder straps. For example, the chest protector 100 may include at least two upper shoulder straps attached to each respective shoulder pad 14 and at least two lower shoulder straps attached to lateral abdomen pads 18 that are intended to secure the center harness material. More straps may be included in the strapping system of the present invention for extra security and support.

In another embodiment, when the chest pad 10 is utilized as a stand-alone chest protector, the chest pad 10 itself is removably and adjustably attachable to the user. In this aspect, the chest pad 10 may include a strapping system that is provided to secure the chest pad 10 in position. Any of the above-noted strapping systems are suitable for securing the chest pad 10. For example, the chest pad may include a back harness, where the back harness includes a center harness material that is designed to cushion the back of the user and one or more straps attached to the center harness material. The one or more straps may include at least a pair of shoulder straps attached to the chest pad 10 that are intended to secure the back harness. More straps may be included in the strapping system used with the chest pad for extra security and support.

Any of the above-mentioned straps are made of a durable, resilient material. For instance, the straps of the present invention may be made of a woven natural or synthetic material, such as woven nylon. In another embodiment, the straps of the present invention may be made of clastic or neoprene.

In one embodiment, the straps of the present invention may be removably attachable to the chest protector 100 or the chest pad 10 (when utilized as a stand-alone chest protector). In this aspect, the chest protector 100 or chest pad 10 may include a plurality of metal or plastic loops to which any of the above mentioned straps may be fastened. As will be apparent to one of ordinary skill in the art, the loops may be positioned at any location on the chest protector 100 or chest pad 10 that is deemed suitable for fastening a strap and the loops may be used in any quantity deemed necessary. The loops may be connected to webs of nylon or similar strap material that are attached to the base 2 and are connected thereto by one or more rivets. Each loop may be composed of a single metal or plastic loop or two metal or plastic loops. Any of the straps contemplated by the present invention may carry hook fasteners for connecting to the loops to securely and adjustably connect the chest protector 100 or chest pad 10 to the torso of the user.

In another embodiment, the straps of the present invention may be fixedly attached to one side of the chest protector or chest pad, for example, by sewing, stitching, or riveting the straps to the base 2. In this aspect, on the other side of the chest protector 100 or chest pad 10, the straps may be detachably attachable to the chest protector 100 or chest pad 10. For instance, a securing mechanism, such as a hook or clip, is provided on the strap. The securing mechanism removably attaches to a corresponding slot, clip, or hook fixedly attached to the chest protector.

EXAMPLES

The following non-limiting examples are merely illustrative of the preferred embodiments of the present invention, and are not to be construed as limiting the invention, the scope of which is defined by the appended claims.

Example 1

Testing Conditions

Figure 7:
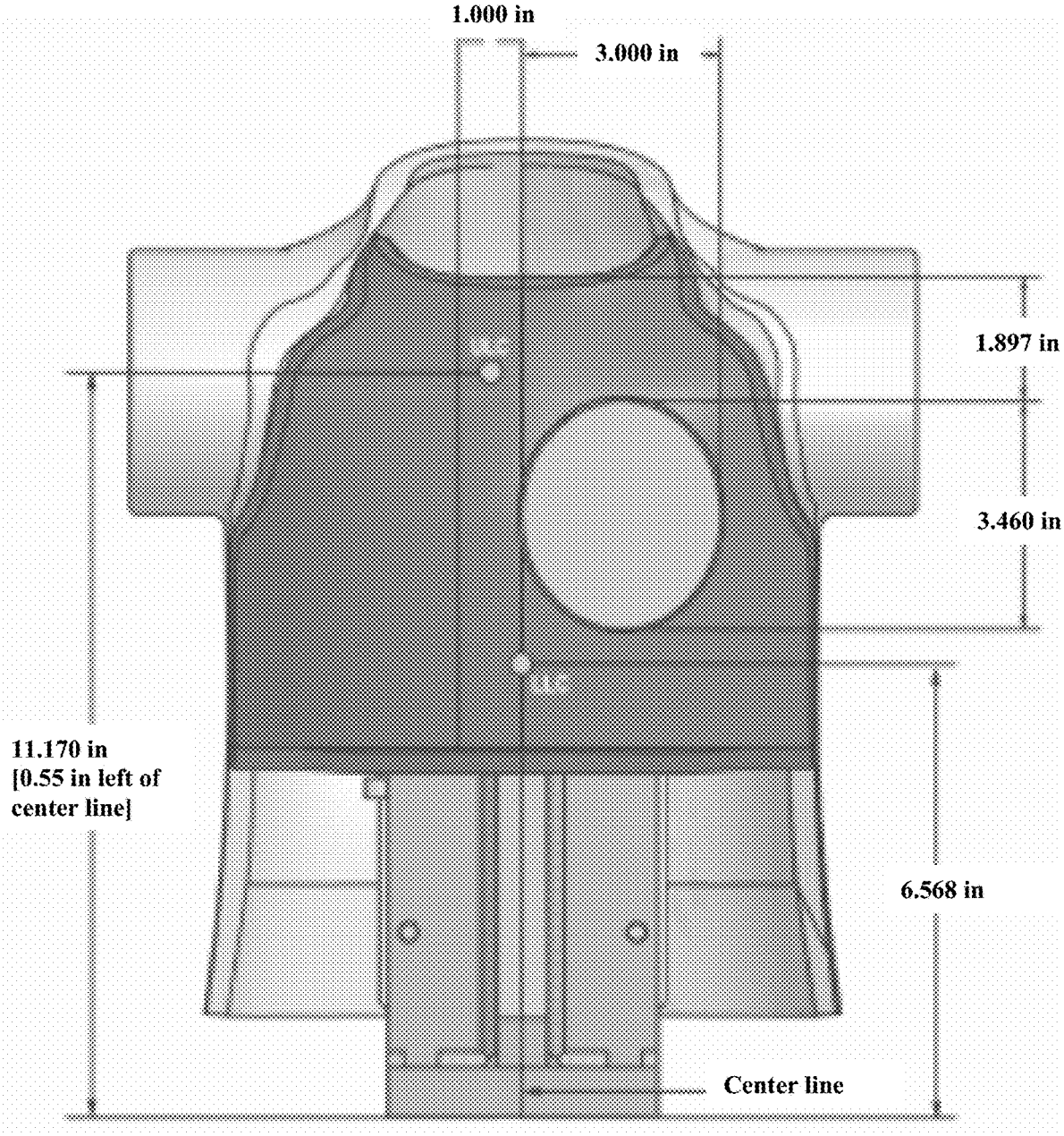
FIGS. 7 and 8 show the load cell positions and padded impact area on the mechanical surrogate used for testing of the chest protector of the present invention.
Figure 8:
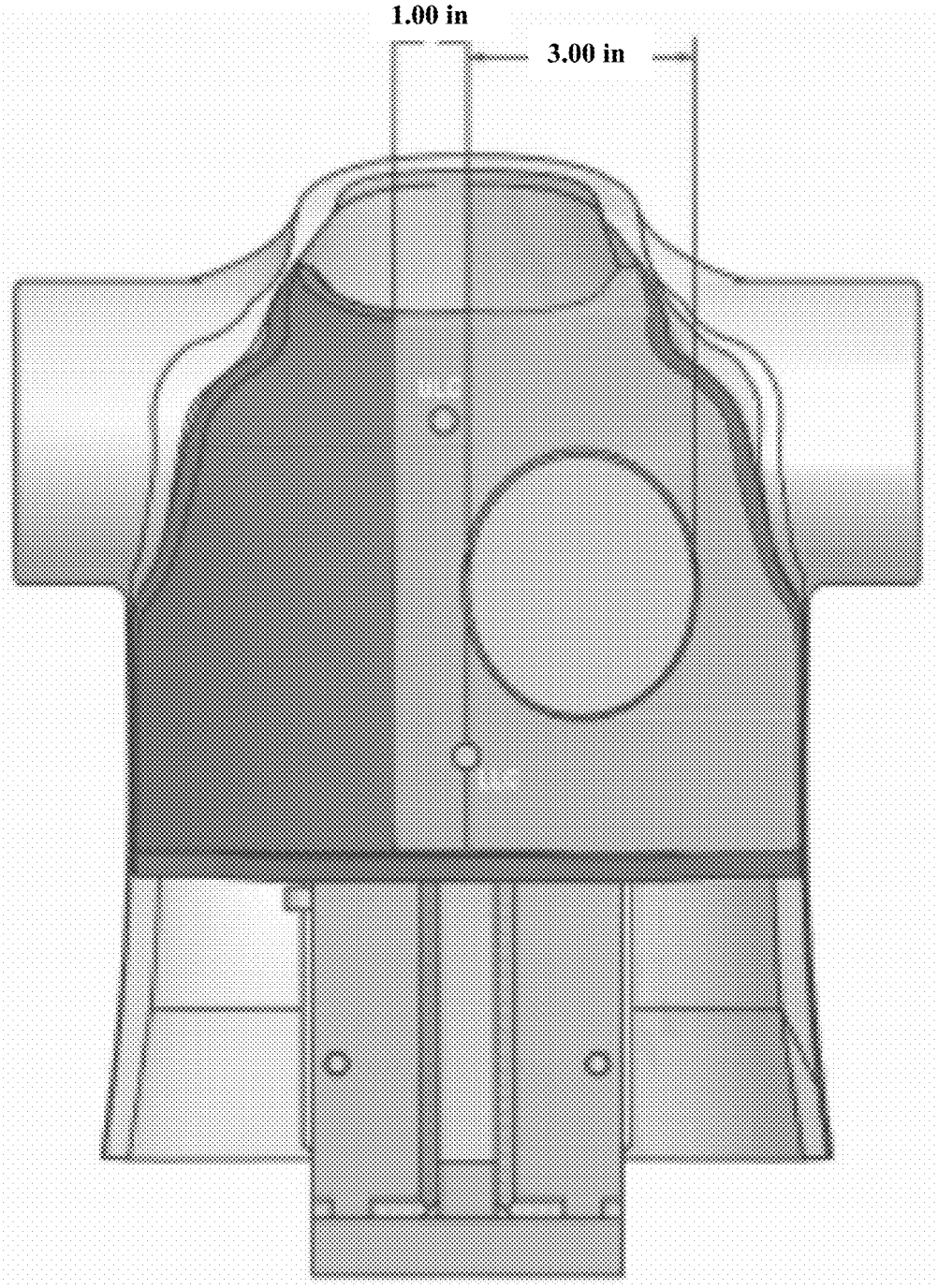

Chest protectors were tested using a mechanical surrogate according to the following test conditions:

1. Environment: testing was conducted after the chest protector, projectile, and mechanical surrogate were exposed to controlled ambient temperature conditions per NOCSAE requirements for at least four hours.
2. Mechanical surrogate: consists of damped loading surface, three single axis load cells (750 lbf maximum capacity capable of measuring force, and a rigid back plate. The three load cells) were positioned in between the loading surface and the back plate and represent the upper chest, lower chest, and cardiac silhouette. The mechanical surrogate was mounted to a linear bearing table capable of providing post impact motion with a weight not to exceed 12.5 lb with the base of the surrogate perpendicular (+/−2.5 degrees) to the line of travel of the projectile.
3. Air Cannon: positioned such that impact occurs to the impact site on the mechanical surrogate within 24 inches from the end of the muzzle (or the point at which the projectile is released).
4. Projectile: regulation baseball with a weight of 5-5.25 ounces, a circumference of 9-9.25 inches, and a C-D at 0.25 inches of 200-300 lbs.
5. Impact location: projectile impacted the center (+/−0.25 inch) of the cardiac silhouette, the lower load cell, and upper load cell as shown in FIG. 7. Random location impacts were directed at points located on padded impact area (FIG. 8) with the initial point of contact for the second random impact point being at least 4 inches away from the initial point of contact for the first random impact point.
6. Control: data was collected after three impacts with the projectile on an unprotected mechanical surrogate at each of the three load cell locations. Impact velocity was 30 mph+/−3 percent with impact at the center (+/−0.25 inch) of the cardiac silhouette, the lower load cell, and upper load cell as shown in FIG. 7.
7. Chest Protectors: each chest protector tested was positioned on the mechanical surrogate according to the manufacturer's fitting instructions. The projectile was propelled at the surrogate from an air cannon such that the impact velocity is within 3 percent of the specified velocity (30 mph and 50 mph) and with impact at the center (+/−0.25 inch) of the cardiac silhouette and two random locations.
8. Pass/fail criteria: provided that (a) for any impact from a 30 mph projectile release, the peak force measured by the cardiac load cell and the upper and lower load cells did not exceed 90 lbf and 112 lbf, respectively and (b) for any impact from a 50 mph projectile release, the peak force measured by the cardiac load cell and the upper and lower load cells did not exceed 180 lbf and 225 lbf, respectively, the chest protector passed.

Results

A 12"×12" cut of various materials was tested for overall effectiveness for use in the chest pad as the innermost layer. The thickness of the material for each cut was 20 mm.

TABLE 1

Test Results or Example 1

| | Example 1 | Example 2 | Example 3 | Example 4 |
|---|---|---|---|---|
| PU foam | D579 | D579 | HS100 | P50 |
| Density | 23 kg/m$^3$ | 23 kg/m$^3$ | 30 kg/m$^3$ | 27 kg/m$^3$ |
| Hardness | 78 | 82 | 88 | 50 |

Of the four examples, Example 2 performed the best. Example 2 tested well at both 30 mph and 50 mph. As such, the polyurethane foam material of Example 2 having a density of 23 kg/m$^3$ and a hardness of 82 was most effective for reducing the risk of occurrence of commotio cordis to a user.

Example 2

Testing Conditions

A chest protector according to one embodiment of the present invention was tested according to NOCSAE Standard ND 200-17am18 "Standard Test Method and Performance Specification Used in Evaluating the Performance Characteristics of Chest Protectors for Commotio Cordis." The chest protector included a chest pad composed of two pads, such as that shown in FIG. 2. Each pad included a polymeric foam layer, a polymeric thermoplastic layer, a memory foam layer, and a layer of ethylene-vinyl acetate. The polymeric foam layer was arranged directly adjacent to the polymeric thermoplastic layer, the polymeric thermoplastic layer was arranged directly adjacent to the layer of ethylene-vinyl acetate, and the layer of ethylene-vinyl acetate was arranged directly adjacent to the memory foam layer. The layers were arranged in a vacuum formed tray.

According to the testing standards for the 30 mile per hour condition, for any impact, the peak force measured by the cardiac load cell ("CLC") shall not exceed 90 lbf (400N) and the peak force measured by the upper chest load cell ("ULC") or lower chest load cell ("LLC") shall not exceed 112 lbf (498 N). For the 50 mile per hour condition, for any impact, the peak force measured by the CLC shall not exceed 180 lbf (800N) and the peak force measured by the ULC or LLC shall not exceed 225 lbf (1001 N).

The laboratory, samples and ball conditioning parameters are set forth in Table 2 below.

TABLE 2

Laboratory, Samples and Ball Conditioning Parameters

| Lab Temperature (° F.) | | | Lab % Relative Humidity | | |
|---|---|---|---|---|---|
| Average | Min | max | Average | Min | Max |
| 70.7 | 69.4 | 71.5 | 46.0 | 44.6 | 46.8 |

The test was carried out under the following laboratory conditions: 71.3° F. and 48.2% relative humidity.

Results

The results of the chest protector impact tests are shown below in Table 3 (30 mile per hour condition) and Table 4 (50 mile per hour condition).

TABLE 3

Chest Protector Impact Test (30 mph condition)

| | Velocity MPH | Ibsf | | |
|---|---|---|---|---|
| Target | (30 ± 3%) | CLC | ULC | LLC |
| CLC | 30.26 | 67.88 | 24.19 | 12.84 |
| ULC | 29.86 | 27.69 | 67.20 | <10* |
| LLC | 30.16 | 26.98 | 14.84 | 51.06 |

*The laboratory where the above testing occurred utilizes the label, "<10", for all values less than 10 due to system variation.

TABLE 4

Chest Protector Impact Test (50 mph condition)

| | Velocity MPH | Ibsf | | |
|---|---|---|---|---|
| Target | (50 ± 3%) | CLC | ULC | LLC |
| CLC | 50.02 | 144.75 | 50.82 | 23.46 |
| ULC | 50.99 | 52.87 | 182.51 | <10 |
| LLC | 50.02 | 49.39 | 25.49 | 139.63 |

As can be seen from the above results, the chest protector passed each of the tests by a large margin. This means that the chest protector (and accompanying chest pad) according to the present invention may significantly reduce the risk of occurrence of commotio cordis to a user.

Example 3

Testing Conditions

A chest protector according to one embodiment of the present invention was tested according to NOCSAE Standard ND 200-17a m18 "Standard Test Method and Performance Specification Used in Evaluating the Performance Characteristics of Chest Protectors for Commotio Cordis." The chest protector included a unitary chest pad. The chest pad included a polymeric foam layer, a polymeric thermoplastic layer, and a memory foam layer. The polymeric foam layer was arranged directly adjacent to the polymeric thermoplastic layer and the polymeric thermoplastic layer was arranged directly adjacent to the memory foam layer.

According to the testing standards for the 30 mile per hour condition, for any impact, the peak force measured by the cardiac load cell ("CLC") shall not exceed 90 lbf (400N) and the peak force measured by the upper chest load cell ("ULC") or lower chest load cell ("LLC") shall not exceed 112 lbf (498 N). For the 50 mile per hour condition, for any impact, the peak force measured by the CLC shall not exceed 180 lbf (800N) and the peak force measured by the ULC or LLC shall not exceed 225 lbf (1001 N).

The laboratory, samples and ball conditioning parameters are set forth in Table 5 below.

TABLE 5

Laboratory, Samples and Ball Conditioning Parameters

| Lab Temperature (° F.) | | | Lab % Relative Humidity | | |
|---|---|---|---|---|---|
| Average | Min | max | Average | Min | Max |
| 71.1 | 70.4 | 71.9 | 48.2 | 47.0 | 49.4 |

The test was carried out under the following laboratory conditions: 71.5° F. and 47.7% relative humidity.

Results

The results of the chest protector impact tests are shown below in Table 6 (30 mile per hour condition) and Table 7 (50 mile per hour condition).

TABLE 6

Chest Protector Impact Test (30 mph condition)

| | Velocity (30 ± 3%) | Ibsf | | |
|---|---|---|---|---|
| Target | MPH | CLC | ULC | LLC |
| CLC | 30.36 | 56.76 | 19.48 | 11.97 |
| ULC | 30.66 | 24.01 | 78.93 | <10 |
| LLC | 30.16 | 18.90 | 12.79 | 65.97 |

TABLE 7

Chest Protector Impact Test (50 mph condition)

| | Velocity (50 ± 3%) | Ibsf | | |
|---|---|---|---|---|
| Target | MPH | CLC | ULC | LLC |
| CLC | 50.43 | 143.76 | 61.26 | 25.24 |
| ULC | 50.49 | 49.79 | 167.65 | 10.30 |
| LLC | 50.79 | 42.40 | 23.78 | 150.57 |

As can be seen from the above results, the chest protector passed each of the tests by a large margin. This means that the chest protector (and accompanying chest pad) according to the present invention may significantly reduce the risk of occurrence of commotio cordis to a user.

Example 4

Testing Conditions

A chest protector according to one embodiment of the present invention was tested according to NOCSAE Standard ND 200-17am 18 "Standard Test Method and Performance Specification Used in Evaluating the Performance Characteristics of Chest Protectors for Commotio Cordis." The chest protector included a unitary chest pad. The chest pad included a polymeric foam layer, a polymeric thermoplastic layer, and a memory foam layer. The polymeric foam layer was arranged directly adjacent to the polymeric thermoplastic layer and the polymeric thermoplastic layer was arranged directly adjacent to the memory foam layer.

According to the testing standards for the 30 mile per hour condition, for any impact, the peak force measured by the cardiac load cell ("CLC") shall not exceed 90 lbf (400N) and the peak force measured by the upper chest load cell ("ULC") or lower chest load cell ("LLC") shall not exceed 112 lbf (498 N). For the 50 mile per hour condition, for any impact, the peak force measured by the CLC shall not exceed 180 lbf (800N) and the peak force measured by the ULC or LLC shall not exceed 225 lbf (1001 N).

The laboratory, samples and ball conditioning parameters are set forth in Table 8 below.

TABLE 8

| Laboratory, Samples and Ball Conditioning Parameters | | | | | |
|---|---|---|---|---|---|
| Lab Temperature (° F.) | | | Lab % Relative Humidity | | |
| Average | Min | max | Average | Min | Max |
| 71.1 | 70.4 | 71.9 | 48.2 | 47.0 | 49.4 |

The test was carried out under the following laboratory conditions: 71.5° F. and 47.7% relative humidity.

Results

The results of the chest protector impact tests are shown below in Table 9 (30 mile per hour condition) and Table 10 (50 mile per hour condition).

TABLE 9

| Chest Protector Impact Test (30 mph condition) | | | | |
|---|---|---|---|---|
| | Velocity (30 ± 3%) | Ibsf | | |
| Target | MPH | CLC | ULC | LLC |
| CLC | 29.62 | 64.38 | 23.31 | 12.24 |
| ULC | 30.09 | 32.18 | 72.41 | <10 |
| LLC | 29.93 | 20.57 | 10.67 | 74.08 |

TABLE 10

| Chest Protector Impact Test (50 mph condition) | | | | |
|---|---|---|---|---|
| | Velocity (50 ± 3%) | Ibsf | | |
| Target | MPH | CLC | ULC | LLC |
| CLC | 49.67 | 140.79 | 65.41 | 25.53 |
| ULC | 49.76 | 53.56 | 167.57 | 10.60 |
| LLC | 51.16 | 49.53 | 22.18 | 153.01 |

As can be seen from the above results, the chest protector passed each of the tests by a large margin. This means that the chest protector (and accompanying chest pad) according to the present invention may significantly reduce the risk of occurrence of commotio cordis to a user.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective testing measurements. Furthermore, when numerical ranges of varying scope are set forth herein, it is contemplated that any combination of these values inclusive of the recited values may be used.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims. All patents and patent applications cited in the foregoing text are expressly incorporated herein by reference in their entirety.

What is claimed is:

1. A chest protector comprising:

a base;

a chest pad fastened to a front side of the base configured to correspond to the user's chest, wherein the chest pad comprises a first layer having a first density and a first hardness, a second layer having a second density and a second hardness, and a third layer having a third density and a third hardness, wherein the second density is greater than the first and third densities, wherein the third density is greater than the first density, wherein the third hardness is less than the first and second hardnesses, and wherein the first hardness is greater than the second hardness; and a strapping system configured to removably and adjustably attach the chest protector.

2. The chest protector of claim 1, further comprising a plurality of shoulder pads fastened to a front side of the base and configured to correspond to the user's shoulders.

3. The chest protector of claim 1, wherein the first hardness ranges from 75 to 85 Shore D.

4. The chest protector of claim 1, wherein the third hardness ranges from 14 to 38 Shore D.

5. The chest protector of claim 1, wherein the first layer is arranged directly adjacent to the base, the second layer is arranged directly adjacent to the first layer, and the third layer is arranged directly adjacent to the second layer such that the third layer is the outermost layer.

6. The chest protector of claim 1, further comprising a plurality of abdomen pads, wherein the plurality of abdomen pads comprises one or more upper abdomen pads configured to correspond to an upper portion of the user's abdomen, one or more lower abdomen pads configured to correspond to a lower portion of the user's abdomen, and one or more lateral abdomen pads configured to correspond to lateral sides of the user's abdomen.

7. The chest protector of claim 1, wherein the first density is 13 kg/m$^3$ to 33 kg/m$^3$, the second density is 85 kg/m$^3$ to 98 kg/m$^3$, and the third density is 47 kg/m$^3$ to 70 kg/m$^3$.

8. The chest protector of claim 1, wherein the first density is 18 kg/m$^3$ to 28 kg/m$^3$, the second density is 88 kg/m$^3$ to 96 kg/m$^3$, and the third density is 50 kg/m$^3$ to 65 kg/m$^3$.

9. A chest protector comprising:

a base;

a chest pad fastened to a front side of the base configured to correspond to the user's chest, wherein the chest pad comprises a first layer having a first density and a first hardness, a second layer having a second density and a second hardness, and a third layer having a third density and a third hardness, wherein the second density is greater than the first density, wherein the third density is greater than the first density by at least 10 kg/m$^3$, wherein the third hardness is less than the first and second hardnesses, and wherein the first hardness is greater than the second hardness; and a strapping system configured to removably and adjustably attach the chest protector.

10. The chest protector of claim 9, wherein the second density ranges from 85 kg/m$^3$ to 98 kg/m$^3$.

11. The chest protector of claim 9, wherein the first layer has a first thickness, the second has a second thickness, and the third layer has a third thickness, and wherein the second thickness is less than the first and third thicknesses.

12. The chest protector of claim 11, wherein the first thickness is 19 mm to 30 mm, the second thickness is 3.98 mm to 6 mm, and the third thickness is 12 mm to 20 mm.

13. The chest protector of claim 12, wherein the first thickness is 20 mm to 25 mm, the second thickness is 4 mm to 5 mm, and the third thickness is 14 mm to 16 mm.

14. The chest protector of claim 9, wherein the first hardness is 75 to 85.

15. The chest protector of claim 14, wherein the third hardness is 14 to 38.

16. A chest protector comprising:

a base;

a chest pad fastened to a front side of the base configured to correspond to the user's chest, wherein the chest pad comprises a first layer having a first density, a first hardness, and a first thickness, a second layer having a second density, a second hardness, and a second thickness, and a third layer having a third density, a third hardness, and a third thickness, wherein the second density is greater than the first density, wherein the third density is greater than the first density, wherein the third hardness is less than the first and second hardnesses, wherein the first hardness is greater than the second hardness, and wherein the second thickness is less than the first and third thicknesses; and a strapping system configured to removably and adjustably attach the chest protector.

17. The chest protector of claim 16, wherein the third density is greater than the first density by at least 10 kg/m$^3$.

18. The chest protector of claim 17, wherein the third density is greater than the first density by at least 20 kg/m$^3$.

19. The chest protector of claim 16, further comprising a plurality of abdomen pads, wherein the plurality of abdomen pads comprises one or more upper abdomen pads configured to correspond to an upper portion of the user's abdomen, one or more lower abdomen pads configured to correspond to a lower portion of the user's abdomen, and one or more lateral abdomen pads configured to correspond to lateral sides of the user's abdomen.

20. The chest protector of claim 19, further comprising a plurality of shoulder pads fastened to a front side of the base configured to correspond to a user's shoulders.

* * * * *